US010577729B2

(12) United States Patent
Ban et al.

(10) Patent No.: US 10,577,729 B2
(45) Date of Patent: Mar. 3, 2020

(54) SPUN YARN COMPRISING CARBON STAPLE FIBERS AND METHOD OF PREPARING THE SAME

(71) Applicant: Lotte Advanced Materials Co., Ltd., Yeosu-si (KR)

(72) Inventors: Kyun Ha Ban, Uiwang-si (KR); Yun Seok Bae, Uiwang-si (KR); Chang Min Hong, Uiwang-si (KR)

(73) Assignee: Lotte Advanced Materials Co., Ltd., Yeosu-si (KR)

( * ) Notice: Subject to any disclaimer, the term of this patent is extended or adjusted under 35 U.S.C. 154(b) by 144 days.

(21) Appl. No.: 15/687,795

(22) Filed: Aug. 28, 2017

(65) Prior Publication Data

US 2018/0057970 A1 Mar. 1, 2018

(30) Foreign Application Priority Data

Aug. 29, 2016 (KR) ..... 10-2016-0110369

(51) Int. Cl.
*D01D 5/26* (2006.01)
*D02G 3/04* (2006.01)

(52) U.S. Cl.
CPC ..... *D02G 3/047* (2013.01); *D01D 5/26* (2013.01)

(58) Field of Classification Search
CPC . D02G 3/047; D02G 3/16; D01D 5/26; D10B 2101/12; D10B 2331/02; D10B 2331/04
USPC ..... 57/255
See application file for complete search history.

(56) References Cited

U.S. PATENT DOCUMENTS

| | | | | |
|---|---|---|---|---|
| 3,628,995 | A * | 12/1971 | Economy | D01F 6/76 428/421 |
| 4,014,725 | A * | 3/1977 | Schulz | D01F 9/145 156/148 |
| 4,457,345 | A * | 7/1984 | von Blucher | D02G 3/16 139/420 R |
| 5,328,764 | A * | 7/1994 | McCullough, Jr. | D01F 9/225 428/364 |
| 6,583,075 | B1 * | 6/2003 | Dugan | D01F 8/08 428/373 |
| 8,349,447 | B2 * | 1/2013 | Nakayama | C08J 7/045 428/331 |
| 10,145,028 | B2 | 12/2018 | Choi et al. | |
| 2007/0218280 | A1 * | 9/2007 | Yabuki | D01F 1/10 428/366 |
| 2013/0118142 | A1 * | 5/2013 | Gommel | D02G 3/16 57/232 |
| 2013/0192189 | A1 | 8/2013 | Lawrence et al. | |
| 2013/0199412 | A1 | 8/2013 | Christ et al. | |
| 2016/0237248 | A1 | 8/2016 | Christ et al. | |

FOREIGN PATENT DOCUMENTS

| | | | |
|---|---|---|---|
| CN | 104141189 | A | 11/2014 |
| GB | 2477531 | A | 8/2011 |
| GB | 2477534 | A | 8/2011 |
| JP | 2011-122032 | A | 6/2011 |
| KR | 10-2012-0104629 | A | 9/2012 |
| KR | 10-2016-0012429 | A | 2/2016 |
| WO | 2012/000827 | A2 | 1/2012 |

OTHER PUBLICATIONS

Xiaosong Huang: "Fabrication and Properties of Carbon Fibers", Materials, vol. 2, 2009, pp. 2369-2403. PubMed ID 5513585. (Year: 2009).*

Richard Petersen: "Carbon Fiber Biocompatibility for Implants", Fibers (Basel), vol. 4, No. 1, 2016, pp. 1-20. PubMed ID 4782804. (Year: 2016).*

Geraldine Oliveux, et al: "Current status of recycling of fibre reinforced polymers: Review of technologies, reuse and resulting properties", Progress in Materials Science, vol. 72, 2015, pp. 61-99. (Year: 2015).*

Asmatulu, E., Twomey, J., & Overcash, M. (2014). Recycling of fiber-reinforced composites and direct structural composite recycling concept. Journal of Composite Materials, 48(5), 593-608. https://doi.org/10.1177/0021998313476325 (Year: 2014).*

M.H. Akonda., et al. "Recycled Carbon Fibre-Reinforced Polypropylene Thermoplastic Composites." Composites Part A: Applied Science and Manufacturing, vol. 43, No. 1, 2012, pp. 79-86., doi:10.1016/j.compositesa.2011.09.014. (Year: 2011).*

Christelle Morin et al. "Near- and Supercritical Solvolysis of Carbon Fibre Reinforced Polymers (CFRPs) for Recycling Carbon Fibers as a Valuable Resource: State of the Art." The Journal of Supercritical Fluids, vol. 66, 2012, pp. 232-240., doi:10.1016/j.supflu.2012.02.001. (Year: 2012).*

Geraldine, Oliveux, et al: "Current status of recycling of fibre reinforced polymers: review of technologies, reuse, and resulting properties", Progress in Materials Science, vol. 2, 2015, pp. 61-99 (Year: 2015) (Year: 2015).*

Search Report in counterpart European Application No. 17188246.7 dated Feb. 12, 2018, pp. 1-13.

M Hengstermann et al: "Development of new hybrid yarn construction from recycled carbon fibers for high performance composites. Part-I: basic processing of hybrid carbon fiber/polyamide 6 yarn spinning from virgin carbon fiber staple fibers", Textile Research Journal, vol. 86, No. 12, Jul. 5, 2016 (Jul. 5, 2016), pp. 1307-1317, XP055446605, GB.

(Continued)

*Primary Examiner* — Khoa D Huynh
*Assistant Examiner* — Grace Huang
(74) *Attorney, Agent, or Firm* — Additon, Higgins & Pendleton, P.A.

(57) ABSTRACT

Disclosed herein is spun yarn and a method of preparing the same. The spun yarn includes carbon staple fibers including about 97 wt % or more of carbon, and thermoplastic resin fibers. The spun yarn includes carbon staple fibers prepared from scrap generated during manufacture of carbon fiber-reinforced plastic products, and can have good mechanical properties and conductivity.

11 Claims, No Drawings

(56) References Cited

OTHER PUBLICATIONS

Office Action in counterpart Korean Application No. 10-2016-0110369 dated Jun. 20, 2018, pp. 1-6.
Office Action in counterpart Chinese Patent Application No. 201710748513.4 dated Jul. 22, 2019, pp. 1-6.

* cited by examiner

SPUN YARN COMPRISING CARBON STAPLE FIBERS AND METHOD OF PREPARING THE SAME

CROSS-REFERENCE TO RELATED APPLICATION

This application claims priority under 35 USC Section 119 to and the benefit of Korean Patent Application 10-2016-0110369, filed on Aug. 29, 2016, the entire disclosure of which is incorporated herein by reference.

FIELD

The present invention relates to spun yarn comprising carbon staple fibers and a method of preparing the same. More particularly, the present invention relates to spun yarn comprising carbon staple fibers, which are prepared from carbon fiber-reinforced plastic (CFRP) scrap generated during manufacture of carbon fiber-reinforced plastic products, and a method of preparing the same.

BACKGROUND

Since carbon fiber-reinforced plastic (CFRP) is much lighter than metal and has high stiffness, carbon fiber-reinforced plastic is attracting attention as a next generation composite material and can be used to make lightweight structures for automobiles, aircrafts, and the like.

Methods of processing carbon fiber-reinforced plastic is very complicated and is mainly automated, and a large amount of CFRP scrap is generated as residues after manufacture of products. However, it is difficult to discard or recycle the CFRP scrap.

A representative method of recycling CFRP scrap includes introducing CFRP scrap into a compounding product by cutting the CFRP scrap into small pieces and burning the pieces or making the pieces into a master batch, and the like. This method is not widely used due to complexity and low-efficiency thereof. In addition, since carbon fibers having a high carbon content can become a single yarn or can be broken during processing due to high tensile modulus thereof, it can be difficult to manufacture a molded article using recycled CFRP scrap including the carbon fibers. Also, such a molded article can suffer from deterioration in mechanical properties, conductivity and the like due to change of the carbon fibers into a single yarn.

Further, since carbon fibers having a high carbon content break upon preparation of spun yarn, the spun yarn has been prepared from carbon staple fibers, which are manufactured by carbonizing the carbon fibers having a high carbon content together with a polyacrylonitrile polymer at low temperature to have a low carbon content and low tensile modulus. However, this technique is not suitable as a method of recycling CFRP scrap due to complicated manufacturing processes thereof.

Therefore, there is a need for a method of economically recycling CFRP scrap without deterioration in mechanical properties, conductivity and the like.

SUMMARY OF THE INVENTION

Exemplary embodiments provide spun yarn that comprises carbon fiber staples (also referred to herein as carbon staple fibers) having a high carbon content and prepared from carbon fiber-reinforced plastic (CFRP) scrap generated during manufacture of carbon fiber-reinforced plastic products, has good tensile modulus, volume resistivity and the like, and allows the CFRP scrap to be economically recycled with minimal or no deterioration in mechanical properties, conductivity and the like, and a method of preparing the same.

The spun yarn includes carbon staple fibers including about 97% by weight (wt %) or more of carbon, wherein the wt % is based on the total weight of the carbon staple fibers, and thermoplastic resin fibers.

In exemplary embodiments, the carbon staple fibers may be obtained by carbonizing carbon fiber-reinforced plastic scrap at 900° C. to 1,400° C.

In exemplary embodiments, the carbon staple fibers may have a tensile modulus of about 100 GPa to about 1,000 GPa as measured in accordance with ASTM D3379, and a volume resistivity of about $1\times10^{-5}$ Ω·cm to about $1\times10^{-3}$ Ω·cm as measured in accordance with ASTM D257.

In exemplary embodiments, the carbon staple fibers may have an average diameter of about 5 μm to about 10 μm, and an average length of about 20 mm to about 80 mm.

In exemplary embodiments, the thermoplastic resin fibers may include at least one of polyamide fibers, polyester fibers, and acrylic fibers.

In exemplary embodiments, the thermoplastic resin fibers may have an average diameter of about 5 μm to about 30 μm, and an average length of about 10 mm to about 110 mm.

In exemplary embodiments, the spun yarn may include about 10 wt % to about 60 wt % of the carbon staple fibers and about 40 wt % to about 90 wt % of the thermoplastic resin fibers.

In exemplary embodiments, the spun yarn may have a tensile modulus of about 30 GPa to about 120 GPa, as measured in accordance with ASTM D3379.

In exemplary embodiments, the spun yarn may have a volume resistivity of about $1\times10^{2}$ Ω·cm to about $1\times10^{7}$ Ω·cm, as measured in accordance with ASTM D257.

Also provided is a method of preparing the spun yarn set forth above. The method of preparing the spun yarn includes: preparing carbon staple fibers by carbonizing carbon fiber-reinforced plastic scrap at about 900° C. to about 1,400° C.; and preparing the spun yarn by blending the carbon staple fibers and thermoplastic resin fibers.

In exemplary embodiments, the carbon staple fibers may include about 97 wt % or more of carbon, may have an average diameter of about 5 μm to about 10 μm and an average length of about 60 mm to about 120 mm upon manufacture of the carbon staple fibers, and may have an average diameter of about 5 μm to about 10 μm and an average length of about 20 mm to about 80 mm after preparation of the spun yarn.

In exemplary embodiments, the preparing the spun yarn by blending the carbon staple fibers and the thermoplastic resin fibers may include carding, combing, and spinning.

DETAILED DESCRIPTION

The above and other aspects, features, and advantages of the present invention will become apparent from the detailed description of the following embodiments. It should be understood that the present invention is not limited to the following embodiments and may be embodied in different ways, and that the embodiments are provided for complete disclosure and thorough understanding of the present invention by those skilled in the art. The scope of the present invention should be defined only by the appended claims.

Hereinafter, embodiments of the present invention will be described in detail.

Spun yarn according to the present invention includes carbon fiber staples (also referred to herein as carbon staple fibers) and thermoplastic resin fibers.

According to exemplary embodiments of the present invention, the carbon staple fibers are prepared (recycled) from carbon fiber-reinforced plastic (CFRP) scrap, which are residues generated during manufacture of CFRP products. For example, the carbon staple fibers may be obtained by carbonizing carbon fiber-reinforced plastic scrap at about 900° C. to about 1,400° C., for example, about 1,000° C. to about 1,300° C. Within this temperature range, carbon staple fiber including about 97 wt % or more of carbon, wherein the wt % is based on the total weight (100 wt %) of the carbon staple fibers, can be prepared.

In exemplary embodiments, the carbon staple fibers of the spun yarn may include about 97 wt % or more, for example, about 98 wt % to about 99.9 wt %, of carbon, as measured by a thermogravimetric analyzer (TGA), and may have an average diameter (D50) of about 5 μm to about 10 μm, for example, about 6 μm to about 8 μm, and an average length (L50) of about 20 mm to about 80 mm, for example, about 30 mm to about 70 mm, as measured using a microscope. If the amount of carbon in the carbon staple fibers is less than about 97 wt %, the carbon staple fibers can suffer from decrease in tensile modulus and/or increase in volume resistivity. In addition, if the average diameter of the carbon staple fibers is less than about 5 μm, the carbon staple fibers can suffer from increase in volume resistivity, and if the average diameter of the carbon staple fibers is greater than about 10 μm, the carbon staple fibers are more likely to be broken. Further, if the average length of the carbon staple fibers is less than about 20 mm, the carbon staple fibers can suffer from decrease in tensile modulus, and if the average length of the carbon staple fibers is greater than about 80 mm, there is a concern of deterioration in productivity due to deterioration in workability in a carding process during preparation of the spun yarn.

In exemplary embodiments, the carbon staple fibers may have a tensile modulus of about 100 GPa to about 1,000 GPa, for example, about 110 GPa to about 990 GPa, as measured in accordance with ASTM D3379. Within this range, the spun yarn including the carbon staple fibers can have good mechanical properties such as tensile modulus and the like.

In exemplary embodiments, the carbon staple fibers may have a volume resistivity of about $1\times10^{-5}$ Ω·cm to about $1\times10^{-3}$ Ω·cm, for example, about $1.1\times10^{-5}$ Ω·cm to about $0.9\times10^{-3}$ Ω·cm, as measured in accordance with ASTM D257. Within this range, the spun yarn including the carbon staple fibers can have good conductivity and the like.

In exemplary embodiments, the spun yarn can include the carbon staple fibers in an amount of about 10 wt % to about 60 wt %, for example, about 10 wt % to about 50 wt %, and as another example about 15 wt % to about 45 wt %, based on the total weight (100 wt %) of fibers in the spun yarn. In some embodiments, the spun yarn can include the carbon staple fibers in an amount of about 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 wt %. Further, according to some embodiments, the amount of the carbon staple fibers can be in a range from about any of the foregoing amounts to about any other of the foregoing amounts.

Within this range, the spun yarn can have good mechanical properties, conductivity, and the like.

According to exemplary embodiments of the invention, the thermoplastic resin fibers may be typical synthetic fibers and/or fibers formed of a thermoplastic resin used in a thermoplastic resin composition. For example, the thermoplastic resin fibers may have the same components as a thermoplastic resin used in carbon fiber-reinforced plastic products.

In exemplary embodiments, the thermoplastic resin fibers may include polyamide fibers such as aramid fibers and/or nylon fibers, polyester fibers, acrylic fibers, and the like, and combinations thereof.

In exemplary embodiments, the thermoplastic resin fibers may have an average diameter (D50) of about 5 μm to about 30 μm, for example, about 6 μm to about 25 μm, and an average length (L50) of about 10 mm to about 110 mm, for example, about 20 mm to about 100 mm, as measured by a microscope. Within these ranges, the spun yarn can have good mechanical properties and conductivity.

In exemplary embodiments, the spun yarn can include the thermoplastic resin fibers in an amount of about 40 wt % to about 90 wt %, for example, about 50 wt % to about 90 wt %, and as another example about 55 wt % to about 85 wt %, based on the total weight (100 wt %) of fibers in the spun yarn. In some embodiments, the spun yarn can include the thermoplastic resin fibers in an amount of about 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, or 90 wt %. Further, according to some embodiments, the amount of the thermoplastic resin fibers can be in a range from about any of the foregoing amounts to about any other of the foregoing amounts.

Within this range, the spun yarn can have good mechanical properties and conductivity.

According to exemplary embodiments of the invention, the spun yarn may be formed by blending the carbon staple fibers and the thermoplastic resin fibers. For example, the carbon staple fibers may be formed by carbonizing carbon fiber-reinforced plastic scrap at about 900° C. to about 1,400° C., for example, about 1,000° C. to about 1,300° C., and the spun yarn may be formed by blending the carbon staple fibers and the thermoplastic resin fibers.

In exemplary embodiments, the carbon staple fibers (staple fibers before blending) formed by carbonization may include about 97 wt % or more, for example, about 98 wt % to about 99.9 wt % of carbon, as measured by a thermogravimetric analyzer (TGA), and may have an average diameter (D50) of about 5 μm to about 10 μm, for example, about 6 μm to about 8 μm, and an average length (L50) of about 60 mm to about 120 mm, for example, about 65 mm to about 115 mm, as measured by a microscope. Within these ranges, the carbon staple fibers after spinning can have the carbon content, the average diameter and the average length as set forth above, and the spun yarn can have good mechanical properties and conductivity.

In exemplary embodiments, the carbon staple fibers may have a tensile modulus of about 100 GPa to about 1,000 GPa, for example, about 110 GPa to about 990 GPa, as measured in accordance with ASTM D3379. Within this range, the spun yarn including the carbon staple fibers can have good mechanical properties such as tensile modulus.

In exemplary embodiments, the carbon staple fibers may have a volume resistivity of about $1\times10^{-5}$ Ω·cm to about $1\times10^{-3}$ Ω·cm, for example, about $1.1\times10^{-5}$ Ω·cm to about $0.9\times10^{-3}$ Ω·cm, as measured in accordance with ASTM D257. Within this range, the spun yarn including the carbon staple fibers can have good conductivity.

In exemplary embodiments, preparing the spun yarn by blending the carbon staple fibers and the thermoplastic resin fibers may include carding, combing, and spinning. Herein, carding refers to a process of forming thick slivers by arranging and combing the carbon staple fibers and the thermoplastic resin fibers parallel to each other; combing refers to a process of finely combing the slivers again; and spinning refers to a process of drawing and stretching the slivers, completing the spun yarn by twisting the slivers at about 100 twists per meter (TPM) to about 200 TPM, and winding the spun yarn. In addition, optionally, pre-treatment for minimizing breakage of the carbon staple fibers may be added before carding.

The spun yarn according to exemplary embodiments may be formed by economically recycling carbon fiber-reinforced plastic (CFRP) scrap as in the preparation method set forth above, and can realize mechanical properties and conductivity for carbon fiber-reinforced plastic products.

In exemplary embodiments, the spun yarn may have a tensile modulus of about 30 GPa to about 120 GPa, for example, about 50 GPa to about 100 GPa, as measured in accordance with ASTM D3379.

In exemplary embodiments, the spun yarn may have a volume resistivity of about $1\times10^{2}$ Ω·cm to about $1\times10^{7}$ Ω·cm, for example, about $1\times10^{3}$ Ω·cm to about $1\times10^{6}$ Ω·cm, as measured in accordance with ASTM D257.

Next, the present invention will be described in more detail with reference to the following examples. However, it should be understood that these examples are provided for illustration only and are not to be construed in any way as limiting the present invention. Descriptions of details apparent to those skilled in the art will be omitted for clarity.

EXAMPLES

Examples 1 to 4: Preparation of Spun Yarn

Carbon fiber-reinforced plastic (CFRP) scrap including carbon fibers, which include 50 wt % of carbon and have an average diameter (D50) of 6 μm and an average length (L50) of 90 mm, is carbonized at 1,300° C., thereby preparing carbon staple fibers (A1), which include 98 wt % of carbon and have an average diameter (D50) of 6 μm, an average length (L50) of 90 mm, a tensile modulus of 250 GPa, and a volume resistivity of $1\times10^{-4}$ Ω·cm. Next, the carbon staple fibers (A1) and thermoplastic resin fibers (B) (nylon (PA6) fibers, KP Chemtech Co., Ltd.) are mixed in amounts as listed in Table 1, followed by carding, combing and spinning, thereby preparing spun yarn. The carbon staple fibers (A1) in the spun yarn have an average diameter (D50) of 6 μm and an average length (L50) of 50 mm. Tensile modulus and volume resistivity of the spun yarn are measured. Results are shown in Table 1.

Comparative Examples 1 to 4: Preparation of Spun Yarn

Carbon fiber-reinforced plastic (CFRP) scrap including carbon fibers, which include 50 wt % of carbon and have an average diameter (D50) of 6 μm and an average length (L50) of 90 mm, is carbonized at 250° C., thereby preparing carbon staple fibers (A2), which include 60 wt % of carbon and have an average diameter (D50) of 6 μm, an average length (L50) of 90 mm, a tensile modulus of 15 GPa and a volume resistivity of $1\times10^{-1}$ Ω·cm. Next, the carbon staple fibers (A2) and thermoplastic resin fibers (B) (nylon (PA6) fibers, KP Chemtech Co., Ltd.) are mixed in amounts as listed in Table 1, followed by carding, combing and spinning, thereby preparing spun yarn. The carbon staple fibers (A1) in the spun yarn have an average diameter (D50) of 6 μm and an average length (L50) of 50 mm. Tensile modulus and volume resistivity of the spun yarn are measured. Results are shown in Table 1.

Evaluation of Properties (1) Tensile modulus (unit: GPa): Tensile modulus is measured by a universal testing machine (UTM) in accordance with ASTM D3397.

(2) volume resistivity (unit: Ω·cm): volume resistivity is measured by a volume resistivity tester (model: Hiresta-UP (MCP-HT450), Mitsubishi Chemical Co., Ltd.) in accordance with ASTM D257.

TABLE 1

| | Example | | | | Comparative Example | | | |
|---|---|---|---|---|---|---|---|---|
| | 1 | 2 | 3 | 4 | 1 | 2 | 3 | 4 |
| (A1) (wt %) | 50 | 40 | 30 | 20 | — | — | — | — |
| (A2) (wt %) | — | — | — | — | 50 | 40 | 30 | 20 |
| (B) (wt %) | 50 | 60 | 70 | 80 | 50 | 60 | 70 | 80 |
| Tensile modulus | 100 | 80 | 65 | 50 | 7 | 5 | 4 | 3 |
| volume resisitivity | $1\times10^{3}$ | $1\times10^{4}$ | $1\times10^{5}$ | $1\times10^{6}$ | $1\times10^{9}$ | $1\times10^{10}$ | $1\times10^{10}$ | $1\times10^{11}$ |

From the above results, it can be seen that the spun yarn according to the present invention could be prepared from the carbon staple fibers (A1) including 97 wt % or more of carbon and have good mechanical properties (tensile modulus) and conductivity (volume resistivity).

Conversely, it can be seen that the spun yarn including carbon staple fibers, which include less than 97 wt % of carbon, suffer from deterioration in mechanical properties (tensile modulus) and conductivity (volume resistivity).

Exemplary embodiments have been disclosed herein, and although specific terms are employed, they are to be interpreted in a generic and descriptive sense only and not for purpose of limitation. Also although some embodiments have been described above, it should be understood that these embodiments are provided for illustration only and are not to be construed in any way as limiting the present invention, and that various modifications, changes, alterations, and equivalent embodiments can be made by those skilled in the art without departing from the spirit and scope of the invention. The scope of the present invention should be defined by the appended claims and equivalents thereof.

What is claimed is:

1. Spun yarn comprising:

carbon staple fibers comprising 97 wt % or more of carbon, wherein the wt % is based on the total weight of the carbon staple fibers; and thermoplastic resin fibers, wherein the spun yarn has a tensile modulus of 30 GPa to 120 GPa, as measured in accordance with ASTM D3379.

2. The spun yarn according to claim 1, wherein the carbon staple fibers are obtained by carbonizing carbon fiber-reinforced plastic scrap at 900° C. to 1,400° C.

3. The spun yarn according to claim 1, wherein the carbon staple fibers have a tensile modulus of 100 GPa to 1,000 GPa, as measured in accordance with ASTM D3379, and a volume resistivity of $1\times10^{-5}$ Ω·cm to $1\times10^{-3}$ Ω·cm, as measured in accordance with ASTM D257.

4. The spun yarn according to claim 1, wherein the carbon staple fibers have an average diameter of 5 μm to 10 μm and an average length of 20 mm to 80 mm.

5. The spun yarn according to claim 1, wherein the thermoplastic resin fibers comprises polyamide fibers, polyester fibers, and/or acrylic fibers.

6. The spun yarn according to claim 1, wherein the thermoplastic resin fibers have an average diameter of 5 μm to 30 μm and an average length of 10 mm to 110 mm.

7. The spun yarn according to claim 1, wherein the spun yarn comprises 10 wt % to 60 wt % of the carbon staple fibers and 40 wt % to 90 wt % of the thermoplastic resin fibers.

8. The spun yarn according to claim 1, wherein the spun yarn has a volume resistivity of $1\times10^{2}$ Ω·cm to $1\times10^{7}$ Ω·cm, as measured in accordance with ASTM D257.

9. A method of preparing spun yarn, comprising:

preparing carbon staple fibers by carbonizing carbon fiber-reinforced plastic scrap at 900° C. to 1,400° C.; and preparing the spun yarn by blending the carbon staple fibers and thermoplastic resin fibers, wherein the spun yarn has a tensile modulus of 30 GPa to 120 GPa, as measured in accordance with ASTM D3379.

10. The method of preparing spun yarn according to claim 9, wherein the carbon staple fibers comprise 97 wt % or more of carbon, have an average diameter of 5 μm to 10 μm and an average length of 60 mm to 120 mm upon preparation of the carbon staple fibers, and have an average diameter of 5 μm to 10 μm and an average length of 20 mm to 80 mm after preparation of the spun yarn.

11. The method of preparing spun yarn according to claim 9, wherein the step of preparing the spun yarn by blending the carbon staple fibers and the thermoplastic resin fibers comprise carding, combing, and spinning.

* * * * *